United States Patent [19]

Murakami et al.

[11] Patent Number: 4,677,925

[45] Date of Patent: Jul. 7, 1987

[54] METHOD OF INITIALLY SETTING A STEPPING MOTOR IN A SEWING MACHINE

[75] Inventors: Eiji Murakami; Yasuro Sano, both of Tokyo; Tohru Hyodo, Kokubunji, all of Japan

[73] Assignee: Janome Sewing Machine Co. Ltd., Tokyo, Japan

[21] Appl. No.: 761,105

[22] Filed: Jul. 31, 1985

[30] Foreign Application Priority Data

Jul. 31, 1984 [JP] Japan ..... 59-158582

[51] Int. Cl.[4] ..... D05B 3/02

[52] U.S. Cl. ..... 112/266.1; 112/445; 112/453; 112/275

[58] Field of Search ..... 112/445, 453, 455, 456, 112/277, 275, 121.12, 121.11, 262.1, 266.1

[56] References Cited

U.S. PATENT DOCUMENTS 4,480,561 11/1984 Makabe et al. ..... 112/445
4,498,078 2/1985 Yoshimura et al. ..... 112/277 X
4,519,328 5/1985 Takenoya et al. ..... 112/121.12 X

*Primary Examiner*—Peter Nerbun
*Attorney, Agent, or Firm*—Michael J. Striker

[57] ABSTRACT

A stepping motor is initially set while it passes through a full moving range at comparatively low pulse frequency, and it is discriminated whether the motor moves accurately in response to driving pulses between detecting points until the motor passes one detecting point and again reaches this detecting point.

4 Claims, 5 Drawing Figures

METHOD OF INITIALLY SETTING A STEPPING MOTOR IN A SEWING MACHINE

FIELD OF THE INVENTION

This invention relates to a method of initially setting a stepping motor for controlling stitches in a sewing machine.

BACKGROUND OF THE INVENTION

When the stepping motor is used for controlling the stitches, a load torque of a motor should be lower than a generated torque thereof for preventing the stepping motor from going out of service. However, although this condition is satisfied under the normal driving state, the mechanism is made heavy due to, e.g., exposure in the low temperatures, and the load torque is increased, and then if the motor were driven at high speed, it would be out of order.

With respect to a build of the stepping motor and a control thereof, a surplus or room may be kept therefore, but a cost is increased or responsibility at high speed is sacrificed.

SUMMARY OF THE INVENTION

The present invention sets the stepping motor while, at initial setting time, passing it through a full moving region of the motor at comparatively low pulse frequency, and it is discriminated whether the motor moves accurately in response to driving pulses between detecting points until the motor passes one detecting point, and again reaches this detecting point. If it is not normal, an abnormality is indicated.

DETAILED DESCRIPTION OF THE INVENTION

An embodiment of the invention will be explained in reference to the attached drawings. Since a needle amplitude and a fabric feed are the same in regard to controls, an explanation will be made concerning the needle amplitude.

Figure 2:
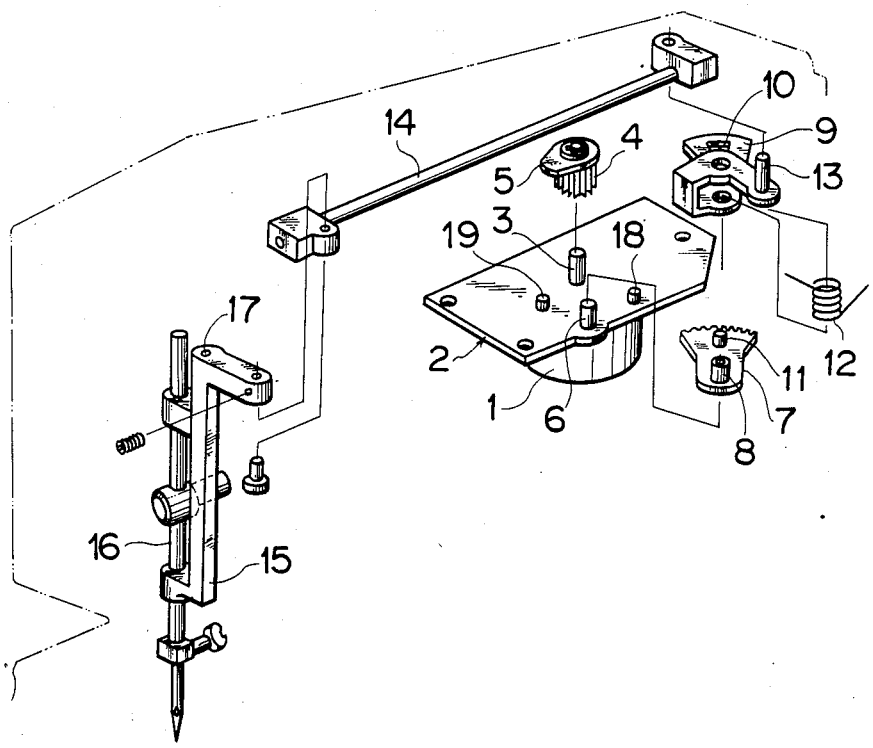
FIG. 2 shows dissolved elemental parts of a sewing machine relating to the present invention.
Figure 3:
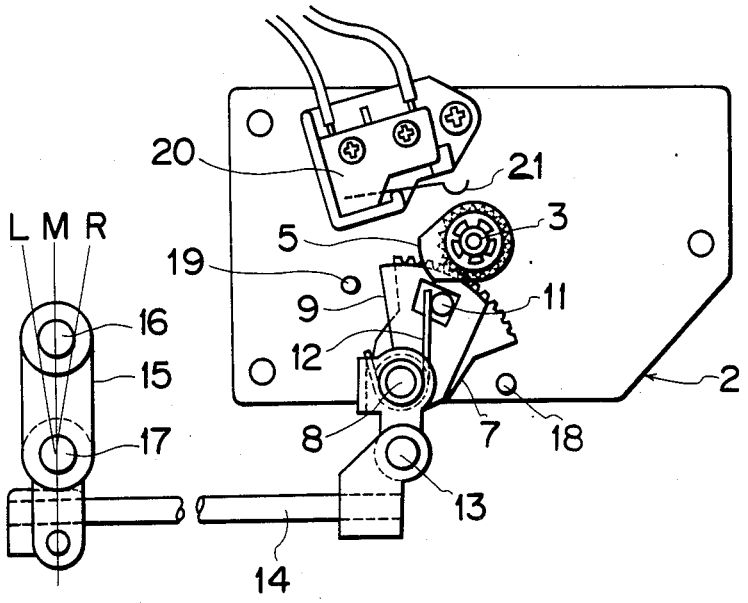
FIG. 3 shows setting of parts thereof.

In FIGS. 2 and 3, a stepping motor 1 for the needle amplitude is fixed to an attaching plate 2. A motor shaft 3 is mounted thereon with a gear 4 and a switch cam 5 for actuating a later mentioned switch. A shaft 6 of the attaching plate 2 is mounted thereon with an actuating gear 7 whose shaft 8 will be attached with an actuating arm 9 formed with a hole 10 to be engaged with a gear shaft 11. The gear 7 and the arm 9 are worked integrally by a coil spring 12. A shaft 13 of the actuating arm 9 is connected to a needle bar supporter 15 via an amplitude rod 14, so that the actuation of the stepping motor 1 is transmitted to the needle supporter 15, and the needle bar 16 is swingingly moved around a turning shaft 17. Stoppers 18, 19 restrain a moving range of the actuating gear 7.

A micro switch 20 is fixed to the attaching plate 2, and an actuator 21 is served by a switch cam 5.

Figure 4:
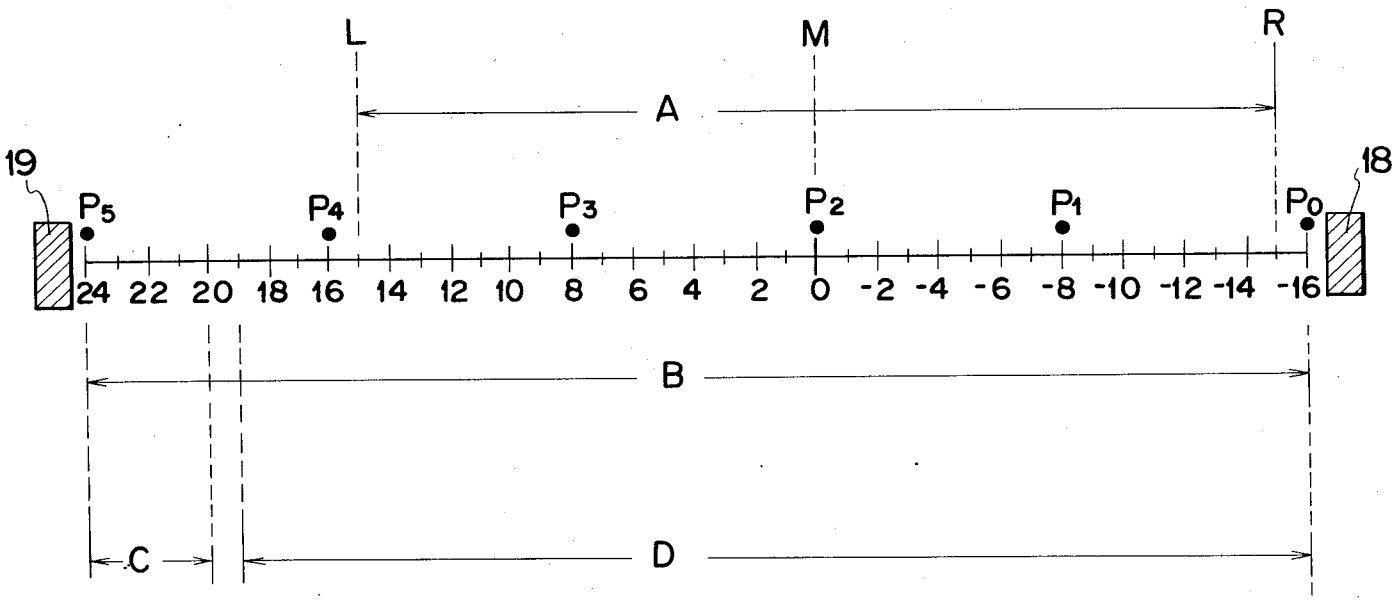
FIG. 4 is an explanatory view of stepping actuation of a stepping motor.

FIG. 4 is an explanatory view concerning actuation of the stepping motor 1 which moves in 40 steps from −16 to 24 of a coordinate between the stoppers 18 and 19.

In a range (A), the stepping motor 1 is driven in actual stitching, a center position (M) thereof is a coordinate 0, a right position (R) is −15 and a left position (L) is 15. FIG. 3 shows these positions (M)(R)(L) which corresponds to the center position of the needle amplitude range, the right end thereof and the left end. In a range (B), the stepping motor 1 is driven at an initially setting time, and this range is a full length from −16 to 24 of the coordinate. A range (C) comprises the coordinates 20 to 24 where the micro switch 20 is turned ON. A range (D) comprises the coordinates −16 to 19 where the micro switch 20 is turned OFF.

At any of the coordinates (P0) to (P5), the stepping motor 1 is positioned when it is energized at a determined energizing phase (called it as PHO). When the energizing phase PHO is energized at ON of the power source, the stepping motor is set at the nearest coordinate among the coordinates (P0) to (P5).

Figure 5:
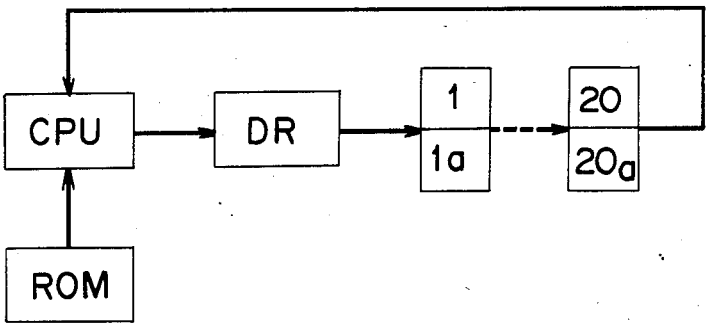
FIG. 5 is a block diagram of the control.

FIG. 5 is a control block diagram, where a central calculation treatment device (CPU) plays an important role of the micro computers, and an initially setting data memory (ROM) stores later mentioned program control signals for initially setting the stepping motor 1. A drive motor (DR) is moved in cooperation of these members, and drives the stepping motor 1 for the needle amplitude and the stepping motor 1*a* for the fabric feed, and receives actuating condition of the micro switch 20 or 20*a*.

Figure 1:
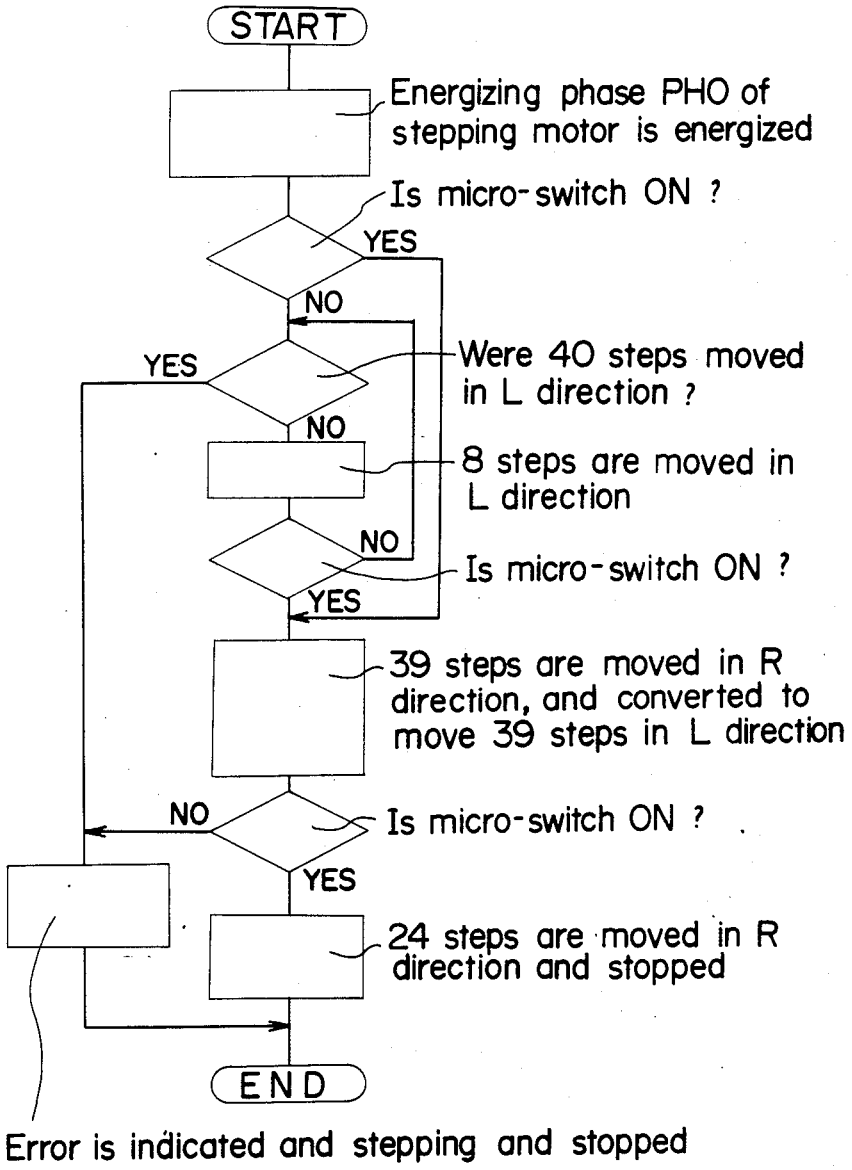
FIG. 1 is a flow chart of initial setting control, showing an embodiment of the invention.

FIG. 1 is a control flow chart. The control is carried out by the micro computer of CPU in dependence upon the data of ROM.

Herein, an explanation will be made to the control of FIG. 1. When the control power source is supplied, the initially setting program is started (START). The determined energizing phase (PHO) of the stepping motor 1 is energized, and the stepping motor 1 is moved to any one of the coordinates (P0) to (P5), and ON or OFF of the micro switch 20 is selected. Now suppose that said moving position is, for example, the coordinate (P3), then the micro switch 20 is OFF. The stepping motor 1 successively changes the energizations, and is moved at low speed by 8 steps in the left direction (L) of FIG. 4 to the coordinate (P4). Since the micro switch 20 is OFF, it is further moved in the left direction by 8 steps to the coordinate point (P5), and the micro switch 20 is turned ON. If the stepping motor 1 does not reach the coordinate point (P5) due to such as heavy load thereon, the micro switch 20 is OFF and the stepping motor is further moved by 8 steps. When the micro switch 20 is turned OFF by the 40 steps, an indicating lamp (not shown) of the sewing machine shows an error and stops (END) the stepping motor 1 and the program. The reason why said total steps are 40, 15 because although the stepping motor 1 is positioned at any one of the coordinates (P0) to (P5) when supplying the power source, the stepping motor 1 can reach all the coordinate (P1) (P5) by the 40 steps.

When the micro switch 20 is turned ON, the stepping motor 1 is moved in the right direction (R) by 39 steps, and is converted at the stopper 18 and moved in the left direction by 39 steps. If the stepping motor is, at this time, turned to the coordinate (P5), the micro switch 20 is ON and the stepping motor is moved in the right direction by 24 steps, and stops at the coordinate (P2). This coordinate (P2) is a center point (M) and is set as an initial standard position, from which the needle amplitude starts controlling. If the micro switch 20 is OFF after 39 steps, an error is indicated, and the stepping motor 1 is stopped.

As mentioned above, according to the invention, the stepping motor is, at initial setting, driven over the full moving range at the low frequency, and the mechanical parts are set. Therefore, although the mechanical part is exposed, e.g., in the low temperatures, and the load torque is made comparatively large, it is normally driven in response to a drive pulse, and said load torque is decreased during the initial setting, so that the normal drive for subsequent stitching is not troubled. The above operation may be performed by easy program without requiring additional members.

What is claimed is:

1. A method for setting a stepping motor to an initial set position at a time that a power supply is applied to an electronic sewing machine incorporating the stepping motor which is used to control under the control of stitch control signals, at least one of a pair of stitch forming elements including a swingable needle and a fabric feeding dog of the sewing machine within a predetermined stitch control range (A) required for producing desired stitches, said stitch control being located within a maximum control range (B) to be rotationally traversed by the stepping motor, said method comprising the steps of: dividing said maximum control range into a predetermined number of steps each corresponding to a rotational step of said stepping motor; providing a plurality of check points ($P_5-P_0$) among said predetermined number of steps with a predetermined number of steps provided therebetween, to which said stepping motor is rotationally positioned with predetermined energizing phases applied thereto, some of said check points being located within said stitch control range (A) and the others being located outside of said stitch control range; providing a detector (20) between two of said check points located outside of said stitch control range, said detector being responsive to the rotation of said stepping motor to produce an electric signal; steppingly rotating said stepping motor at the time the power supply is applied to the sewing machine in one direction to progressively stop said stepping motor at said check points until said electric signal produced by said detector is checked for and confirmed at one of said two check points; further steppingly rotating said stepping motor with a predetermined number of steps from said one check point towards the opposite extreme check point until the stepping motor rotationally moves through all of said stitch control range in one way and returns to said one check point again; and then steppingly rotating said stepping motor with a predetermined number of steps upon generation of said electric signal of said detector until said stepping motor rotationally comes to one of said check points located within said stitch control range.

2. The method as defined in claim 1, further comprising the steps of providing indicator means, and indicating by the indicator means an abnormality when no electric signal is generated by said detector.

3. The method as defined in claim 1, wherein said detector providing step includes providing the detector formed as a microswitch.

4. The method as defined in claim 1, wherein said maximum control range is divided into forty steps including five check points, at least three of which are located within said stitch control range, and the others are located outside of said stitch control range, one being located on one side of said stitch control range and two being located on the opposite side of said stitch control range.

* * * * *